US007025692B2

(12) United States Patent
Erickson et al.

(10) Patent No.: US 7,025,692 B2
(45) **Date of Patent: *Apr. 11, 2006**

(54) MULTIPLE MATERIAL GOLF CLUB HEAD

(75) Inventors: Joel B. Erickson, Carlsbad, CA (US); J. Andrew Galloway, Escondido, CA (US); Alan Hocknell, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 224 days.

This patent is subject to a terminal disclaimer.

(21) Appl. No.: 10/708,052

(22) Filed: Feb. 5, 2004

(65) Prior Publication Data

US 2005/0176522 A1 Aug. 11, 2005

(51) Int. Cl.
*A63B 53/04* (2006.01)

(52) U.S. Cl. ..... 473/335; 473/349; 473/345; 473/346

(58) Field of Classification Search ..... 473/334–339, 473/345–346, 349

See application file for complete search history.

(56) References Cited

U.S. PATENT DOCUMENTS

| | | | | |
|---|---|---|---|---|
| 1,167,387 | A | | 1/1916 | Daniel |
| 1,638,916 | A | * | 8/1927 | Butchart ..... 473/312 |
| 1,780,625 | A | | 11/1930 | Mattern |
| 2,750,194 | A | | 6/1956 | Clark |
| 3,692,306 | A | | 9/1972 | Glover |
| 3,897,066 | A | | 7/1975 | Belmont |
| 3,937,474 | A | | 2/1976 | Jepson et al. |
| 3,970,236 | A | | 7/1976 | Rogers |
| 3,975,023 | A | | 8/1976 | Inamori |
| 3,989,248 | A | | 11/1976 | Campau |
| 4,021,047 | A | | 5/1977 | Mader |
| 4,398,965 | A | | 8/1983 | Campau |
| 4,568,088 | A | | 2/1986 | Kurahashi |
| 4,811,949 | A | | 3/1989 | Kobayashi |
| 4,872,685 | A | | 10/1989 | Sun |
| 4,877,249 | A | | 10/1989 | Thompson |
| 5,024,437 | A | | 6/1991 | Anderson |
| 5,094,383 | A | | 3/1992 | Anderson |
| 5,106,094 | A | | 4/1992 | Desboilles et al. |
| 5,193,811 | A | | 3/1993 | Okumoto et al. |
| 5,255,918 | A | | 10/1993 | Anderson |
| 5,261,663 | A | | 11/1993 | Anderson |
| 5,261,664 | A | | 11/1993 | Anderson |

(Continued)

*Primary Examiner*—Sebastiano Passaniti
(74) *Attorney, Agent, or Firm*—Michael A. Catania; Elaine H. Lo

(57) ABSTRACT

A golf club (40) having a club head (42) with a face component (60) and an aft-body (61) is disclosed herein. The face component (60) has a striking plate portion (72) and a return portion (74). The aft-body (61) is composed of a crown portion (62), a sole portion (64) and optionally a ribbon section (90). The face component (60) is composed of a metal material, and the aft-body (61) is composed of a metal material selected from the group consisting of magnesium alloys, aluminum alloys, magnesium and aluminum. The striking plate portion (72) preferably has an aspect ratio less than 1.7. The striking plate portion (72) preferably has concentric regions of thickness with the thickness portion in the center (102). The club head (42) has a volume in the range of 290 cubic centimeters to 600 cubic centimeters, a weight in the range of 165 grams to 300 grams, and a striking plate portion (72) surface area in the range of 4.00 square inches to 7.50 square inches.

18 Claims, 18 Drawing Sheets

U.S. PATENT DOCUMENTS 5,282,624 A 2/1994 Viste
5,310,185 A 5/1994 Viollaz et al.
5,344,140 A 9/1994 Anderson
5,346,216 A 9/1994 Aizawa
5,377,986 A 1/1995 Viollaz et al.
5,398,935 A 3/1995 Katayamo
5,410,798 A 5/1995 Lo
5,425,538 A 6/1995 Vincent et al.
5,464,210 A 11/1995 Davis et al.
5,474,296 A 12/1995 Schmidt et al.
5,494,281 A 2/1996 Chen
5,499,814 A 3/1996 Lu
5,516,107 A 5/1996 Okumoto et al.
5,518,243 A * 5/1996 Redman ..... 473/334
5,538,246 A 7/1996 Dekura
5,547,427 A 8/1996 Rigal et al.
5,570,886 A 11/1996 Rigal et al.
5,624,331 A 4/1997 Lo et al.
5,720,674 A 2/1998 Galy
5,743,813 A 4/1998 Chen et al.
5,766,089 A 6/1998 Dekura
5,776,011 A 7/1998 Su et al.
5,830,084 A 11/1998 Kosmatka
5,851,160 A 12/1998 Rugge et al.
5,863,261 A 1/1999 Eggiman
5,888,149 A 3/1999 Allen
5,938,541 A 8/1999 Allen
5,954,596 A * 9/1999 Noble et al. ..... 473/346
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,306,048 B1 10/2001 McCabe et al.
6,332,848 B1 12/2001 Long et al.
6,354,962 B1 3/2002 Galloway et al.
6,386,990 B1 5/2002 Reyes et al.
6,398,666 B1 6/2002 Evans et al.
6,440,011 B1 8/2002 Hocknell et al.
6,491,592 B1 12/2002 Cackett et al.
6,533,679 B1 3/2003 McCabe et al.
6,582,323 B1 * 6/2003 Soracco et al. ..... 473/342
6,739,982 B1 * 5/2004 Murphy et al. ..... 473/342
6,860,818 B1 * 3/2005 Mahaffey et al. ..... 473/256
2002/0187853 A1 12/2002 Beach et al.

* cited by examiner

MULTIPLE MATERIAL GOLF CLUB HEAD

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a golf club head with a face component composed of a metal material, and an aft-body composed of a light-weight material. More specifically, the present invention relates to a golf club head with a face component composed of a metal material for a more efficient transfer of energy to a golf ball at impact, and a low density metallic aft-body to control the mass distribution.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a Golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached.

The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to provide a multiple material club head with a high coefficient of restitution, greater forgiveness for the typical golfer and/or optimized mass properties.

SUMMARY OF INVENTION

One aspect of the present invention is a golf club head composed of a metal face component and light-weight aft-body, and having a coefficient of restitution of at least 0.81 under test conditions, such as those specified by the USGA. The standard USGA conditions for measuring the coefficient of restitution is set forth in the *USGA Procedure for Measuring the Velocity Ratio of a Club Head for Conformance to Rule* 4-1*e, Appendix II. Revision I, Aug.* 4, 1998 *and Revision* 0, Jul. 6, 1998, available from the USGA.

Yet another aspect of the present invention is a golf club head including a face component composed of a metal material and an aft-body composed of a metal material selected from the group consisting of magnesium alloys, aluminum alloys, magnesium and aluminum. The face component has a striking plate portion and a return portion. The striking plate portion has a thickness in the range of 0.010 inch to 0.250 inch. The return portion has a thickness in the range of 0.010 inch to 0.200 inch. The aft-body has a crown portion, a sole portion and a ribbon portion. The aft-body is attached to the return portion of the face component. The golf club head has a coefficient of restitution of 0.81 to 0.94.

Yet another aspect of the present invention is golf club head including a face component composed of a metal material and an aft-body composed of a metal material selected from the group consisting of magnesium alloys, aluminum alloys, magnesium and aluminum. The face component has a striking plate portion and a return portion. The aft-body has a crown portion, a sole portion and a ribbon portion. The aft-body is attached to the return portion of the face component. The moment of inertia of the golf club head about the Izz axis through the center of gravity is greater than 3000 grams-centimeter squared, and the moment of inertia about the Iyy axis through the center of gravity is greater than 1800 grams-centimeter squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
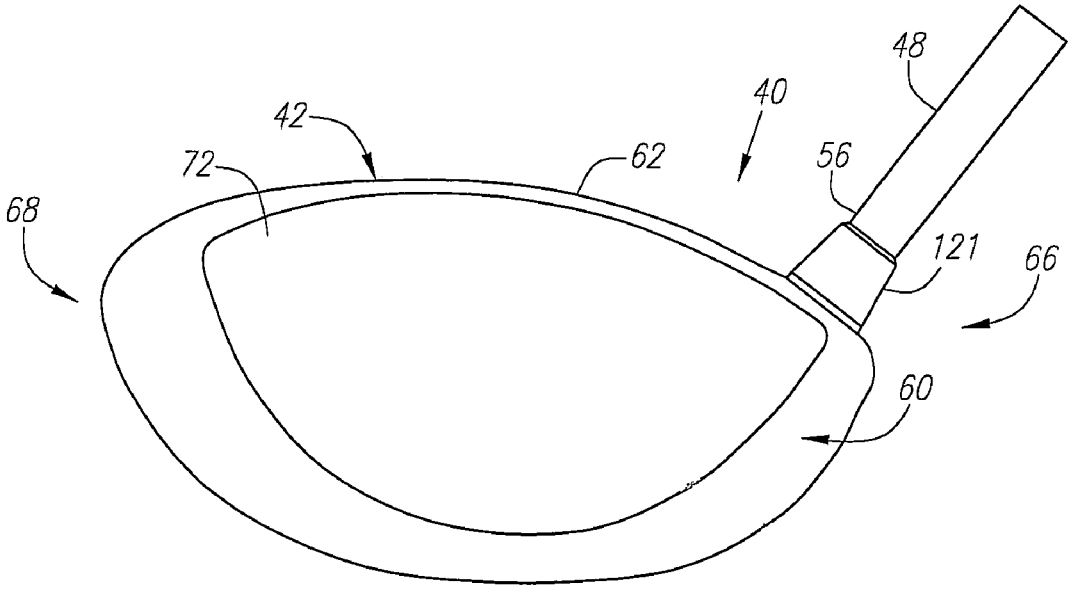
FIG. 1 is a front view of a golf club.

As shown in FIG. 1, a golf club is generally designated 40. The golf club 40 has a golf club head 42. Engaging the club head 42 is a shaft 48 that has a grip 50, not shown, at a butt end 52 and is inserted into a hosel 54 at a tip end 56.

As shown in FIGS. 1A–8, the club head 42 is generally composed of a face component 60 and an aft-body 61. The aft-body is preferably composed of an upper section 200 and a lower section 202, which are joined together to form the aft-body 61. The aft-body 61 preferably has a crown portion 62 and a sole portion 64. The golf club head 42 is preferably has a heel end 66 nearest the shaft 48, a toe end 68 opposite the heel end 66, and a rear end 70 opposite the face component 60.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

FIGS. 20–24 illustrate the face component 60 in isolation. The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel end 66 to the toe section 68. The upper lateral section 76 has a length from the perimeter 73 of the striking plate section 72 that is preferably a minimal length near the center of the striking plate section 72, and increases toward the toe end 68 and the heel end 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The present invention preferably has the face component 60 engage the crown portion 62 of the aft-body 61 along a substantially horizontal plane. The crown 62 has a crown undercut portion 62*a*, which is placed under the return portion 74. Such an engagement enhances the flexibility of the striking plate portion 72, allowing for a greater coefficient of restitution. The crown portion 62 and the upper lateral section 76 are attached to each other as further explained below.

The heel lateral section 80 is substantially perpendicular to the striking plate portion 72, and the heel lateral section 80 covers the hosel 54 before engaging an optional ribbon section 90 and a bottom section 91 of the sole portion 64 of the aft-body 61. The heel lateral section 80 is attached to the sole portion 64, both the ribbon section 90 and the bottom section 91, as explained in greater detail below. The heel lateral section 80 extends inward a distance, d''', from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole portion 64, both the ribbon section 90 and the bottom section 91, as explained in greater detail below. The toe lateral section 82 extends inward a distance, d'', from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a distance, d', to engage the sole portion 64. In a preferred embodiment, the distance d' ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78.

The sole portion 64 has a sole undercut 64*a* for placement under the return portion 74. The sole portion 64 and the lower lateral section 78, the heel lateral section 80 and the toe lateral section 82 are attached to each other as explained in greater detail below.

The aft-body 61 is preferably composed of an upper section 200 and a lower section 202, which are joined together to form the aft-body 61. The aft-body 61 is preferably composed of a low density-metal material, preferably a magnesium alloy, aluminum alloy, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body 61 is preferably manufactured through metal-injection-molding. Alternatively, the aft-body 61 is manufactured through casting, forming, machining, powdered metal forming, electro chemical milling, and the like.

The face component 60 is preferably adhered to the aft-body 61 with an adhesive, which is preferably placed on the interior surface of the return portion 74. The adhesive may also be placed on the undercut portions 62*a* and 64*a* of the aft-body 61. The upper section 200 is preferably adhered to the lower section 202 with an adhesive. Such adhesives include thermosetting adhesives in a liquid or a film medium. A preferred adhesive is a two-part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. The upper section 200 and the lower section 202 may also be secured together by laser welding or brazing.

Figure 25:
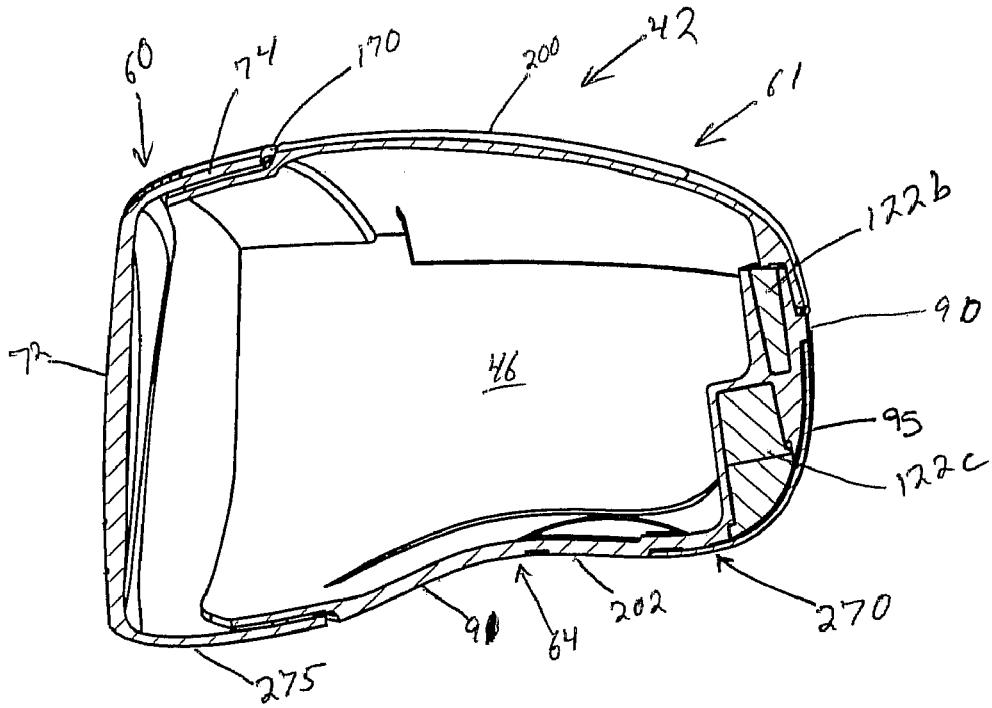
FIG. 25 is a cut-away view along line 25—25 of FIG. 7.
Figure 26:
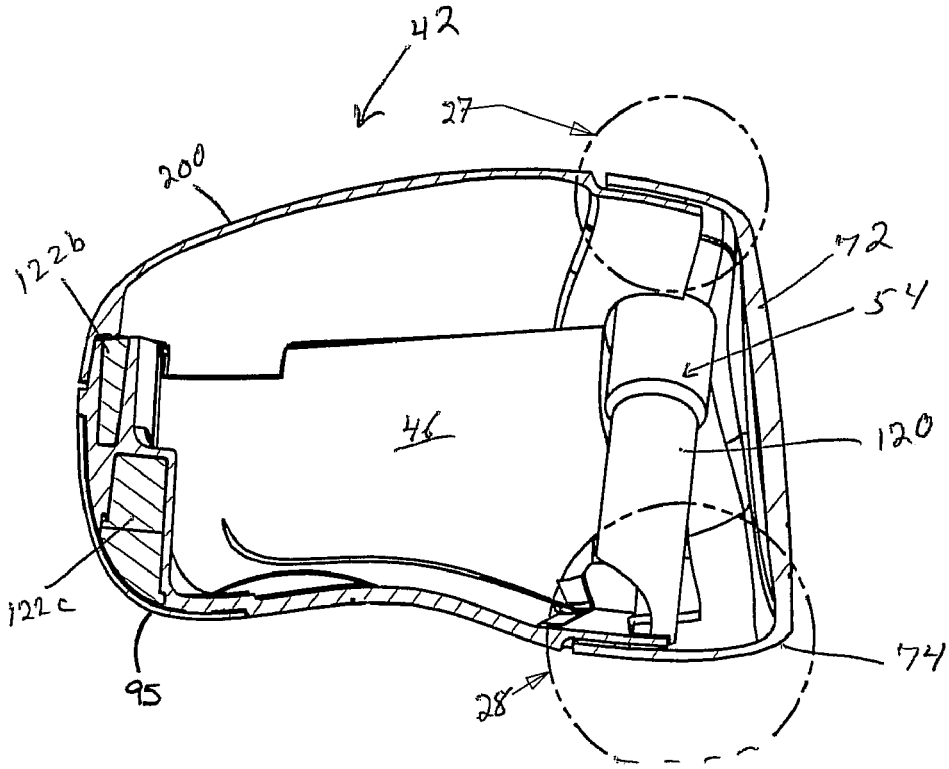
FIG. 26 is a cut-away view along line 26—26 of FIG. 7.
Figure 27:
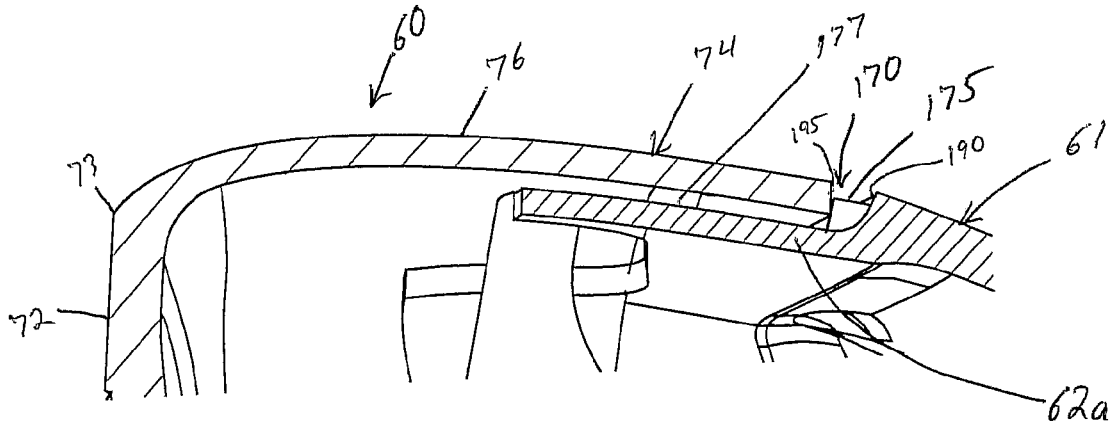
FIG. 27 is an enlarged view of circle 27 of FIG. 26.
Figure 28:
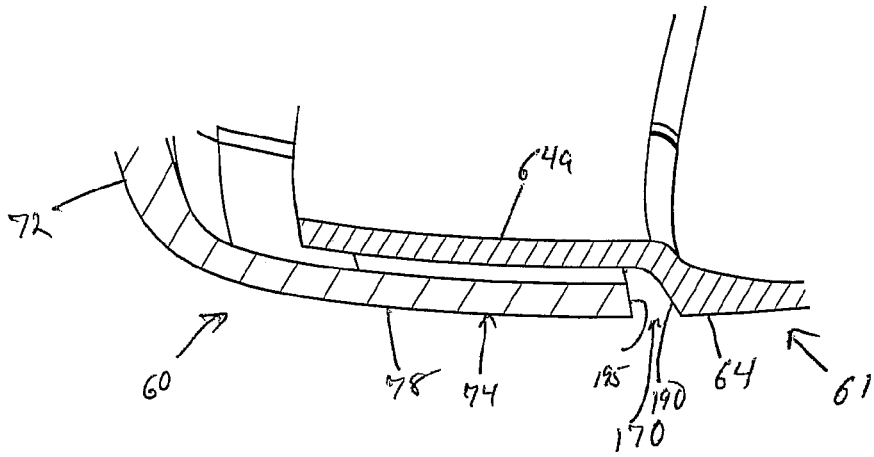
FIG. 28 is an enlarged view of circle 28 of FIG. 26.

As shown in FIGS. 25 and 26, the return portion 74 overlaps the undercut portions 62*a* and 64*a* by a distance ranging from 0.25 inch to 1.00 inch, more preferably ranging from 0.40 inch to 0.70 inch, and most preferably 0.50 inch. An annular gap 170 is created between an edge 190 of the crown portion 62 and the sole portion 64, and an edge 195 of the return portion 74. The annular gap 170 preferably has a distance from the edge 190 of the crown portion 62 to the edge 195 of the return portion 74 ranging from 0.020 inch to 0.100 inch, more preferably from 0.050 inch to 0.070 inch, and most preferably 0.060 inch. A plurality of projections 177 on an outer surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive preferably secures the aft-body 61 to the face component 60. A leading edge of the undercut portions 62*a* and 64*a* may be sealed to prevent the liquid adhesive from entering the hollow interior 46.

Figure 15:
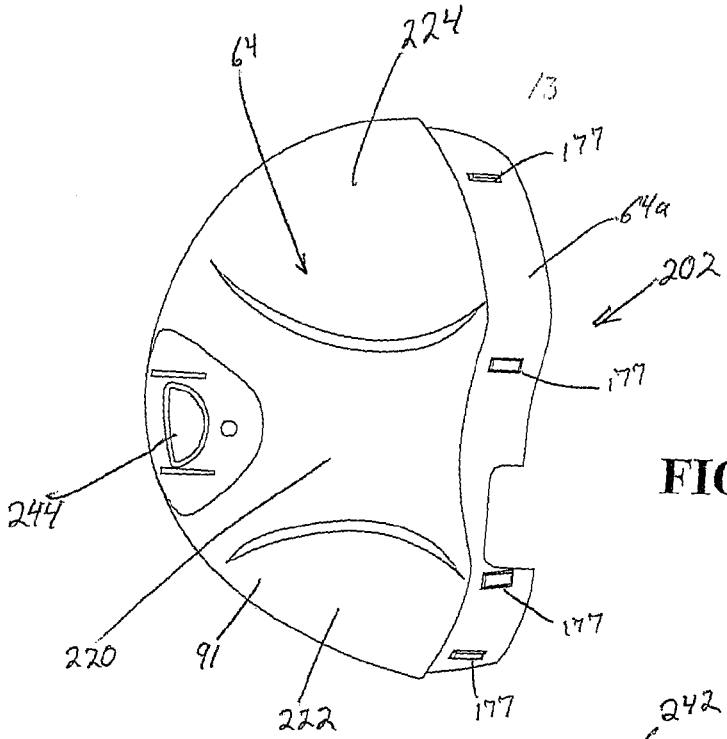
FIG. 15 is an isolated bottom view of a lower section of an aft-body of the golf club head.
Figure 16:
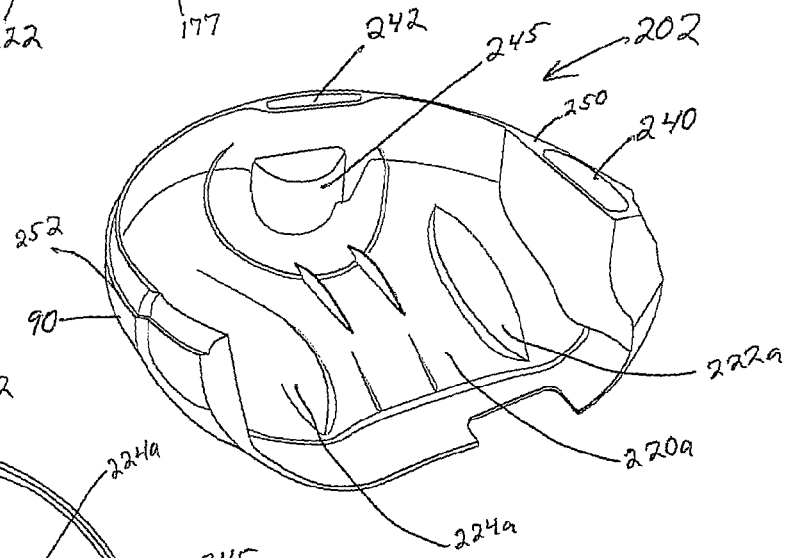
FIG. 16 is a top perspective view of the lower section of the aft-body of FIG. 15.
Figure 17:
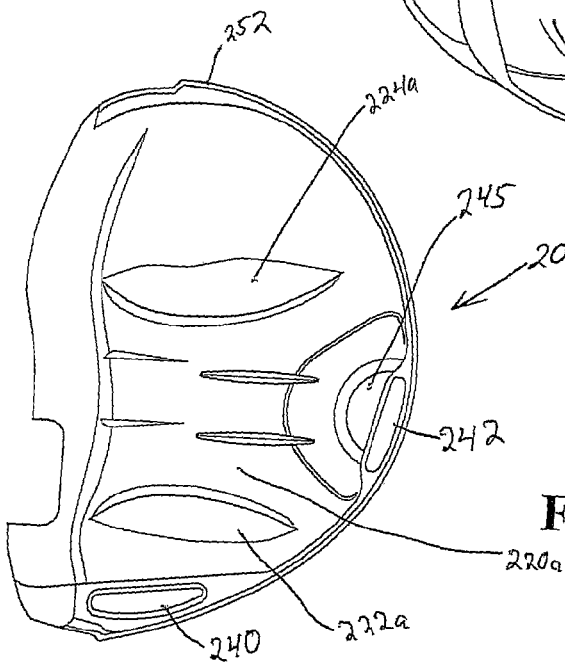
FIG. 17 is a top plan view of the lower section of the aft-body of FIG. 15.

FIGS. 15–17 illustrate a preferred embodiment of the lower section 202 of the aft-body 61. The sole portion 64, including the bottom section 91 and the optional ribbon section 90, which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 64*a* has a similar thickness to the sole portion 64. The lower section 202 preferably comprises the bottom section 91 and a lower portion of the ribbon section 90. The bottom section 91 preferably has a medial ridge 220 which extends from the undercut portion 64*a* rearward. A heel convex portion 222 is preferably located on a heel end 66 next to the medial ridge 220 and a toe convex portion 224 is preferably located on a toe end 68 next to the medial ridge 220. An alternative embodiment of the bottom section 91 is disclosed in U.S. Pat. No. 5,480,152, entitled Hollow, Met allic Golf Club Head With Relieved Sole And Dendritic Structures, assigned to Callaway Golf Company, and which pertinent parts are hereby incorporated by reference.

An aft weight cavity 244 is preferably located rearward of the medial ridge 220. The aft weight cavity 244 preferably allows swing weighting of the golf club head 42. The aft weight cavity 244 is accessible from the exterior of the golf club head 42 when all of the components are joined together. The interior of the lower section 202 has a heel weight cavity 240 and a rear weight cavity 242 for placement of mass prior to assembly of the golf club head components. The interior surface 220*a* of the medial ridge 220 creates a depression in the interior surface of the lower section 202 while the interior surfaces 222*a* and 224*a* of the heel convex portion 222 and toe convex portion 224 create projections in the interior surface of the lower section 202. A wall 245 of the aft weight cavity 244 projects inward from the interior surface of the lower section 202. The lower section 202 has a first ledge 250 and a section ledge 252.

Figure 14:
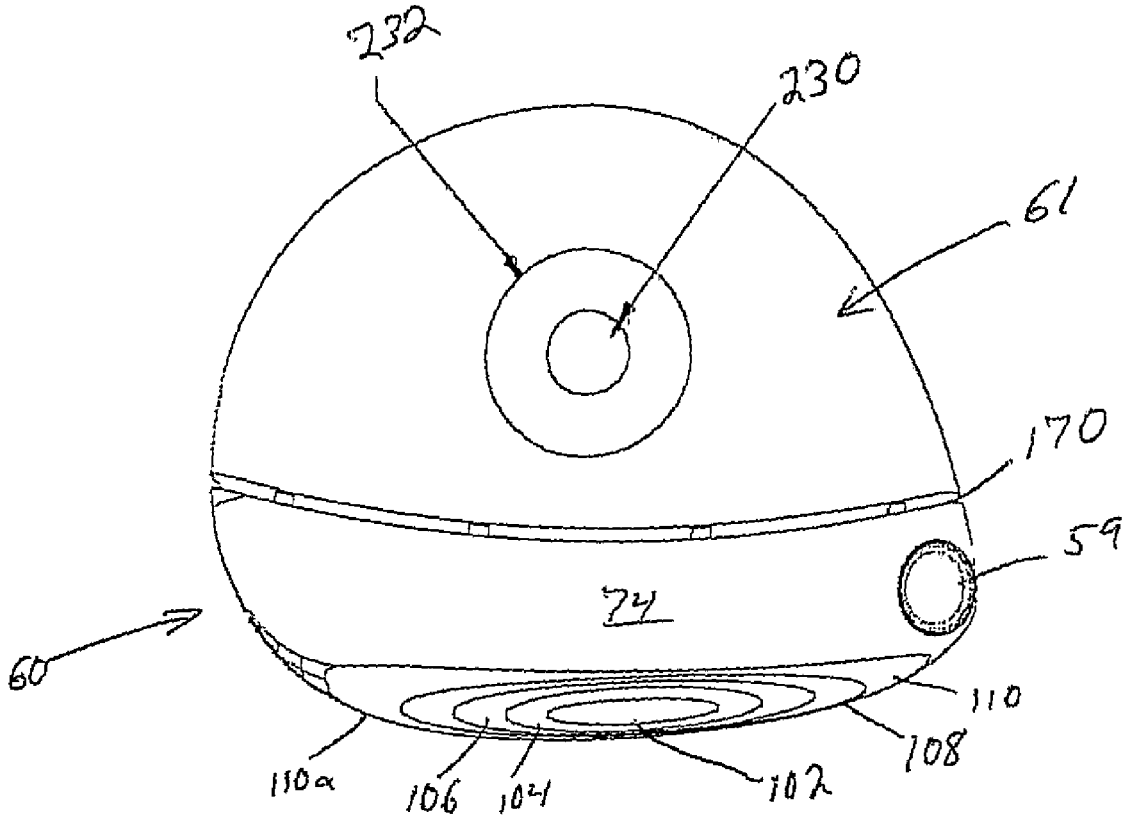
FIG. 14 is a top view of the golf club head illustrating regions of thickness.
Figure 18:
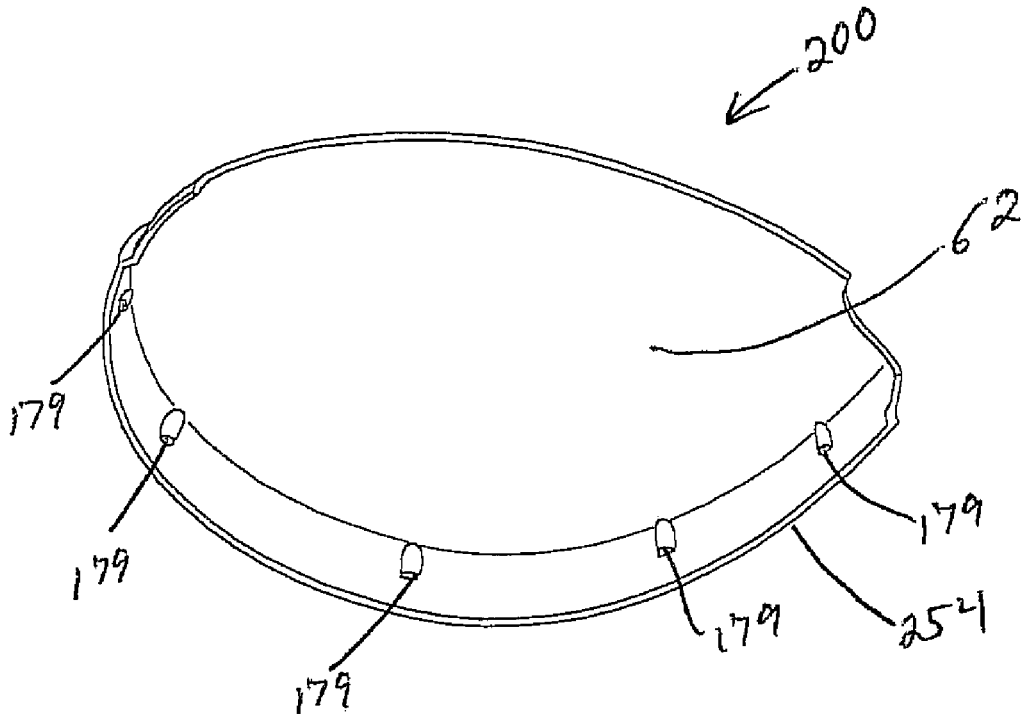
FIG. 18 is an isolated interior view of an upper section of an aft-body of the golf club head.
Figure 19:
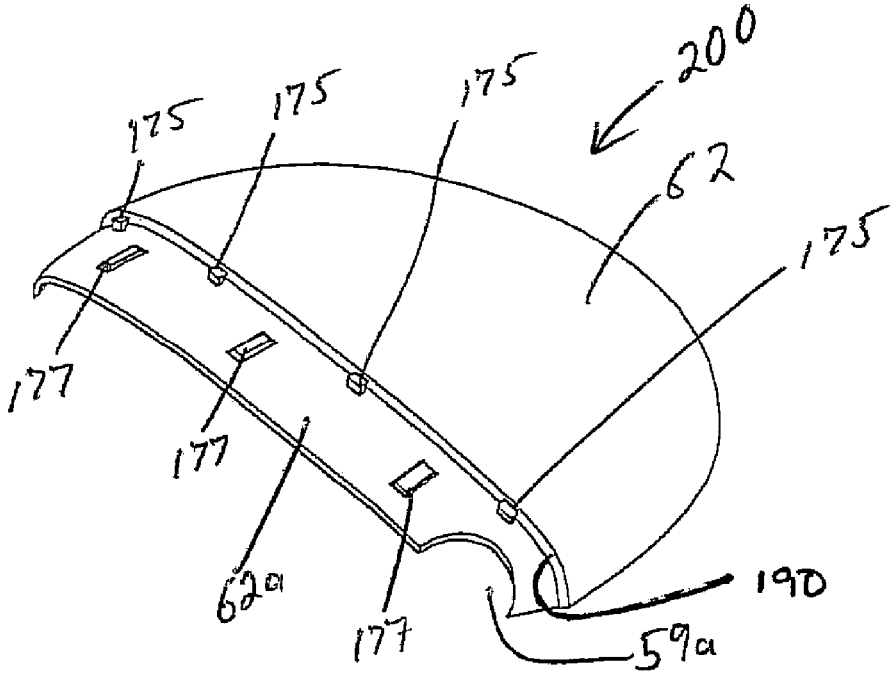
FIG. 19 is an isolated top perspective view of the upper section of the aft-body of FIG. 19.
Figure 20:
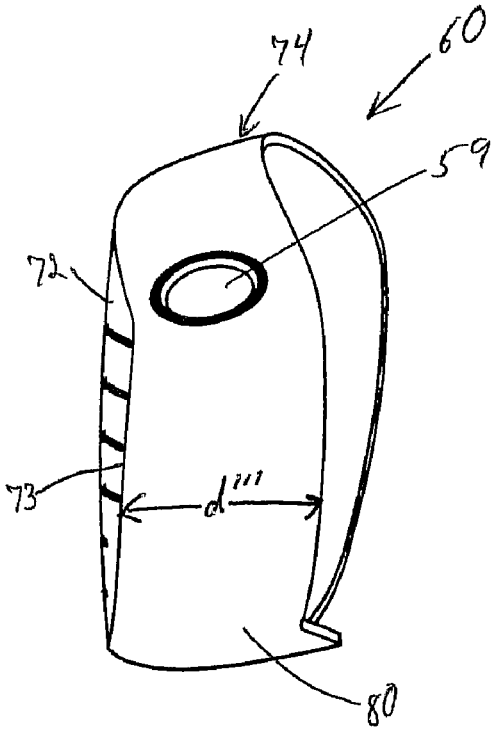
FIG. 20 is an isolated heel view of a face component of the golf club head.
Figure 21:
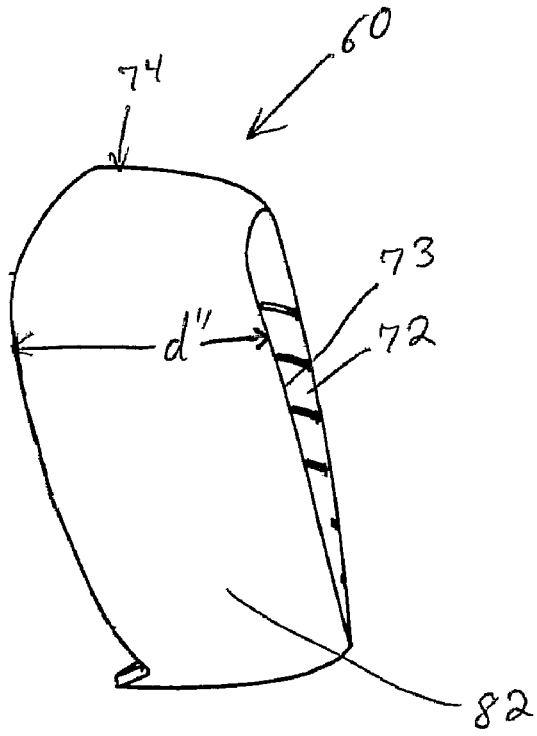
FIG. 21 is an isolated toe view of the face component of FIG. 20.
Figure 22:
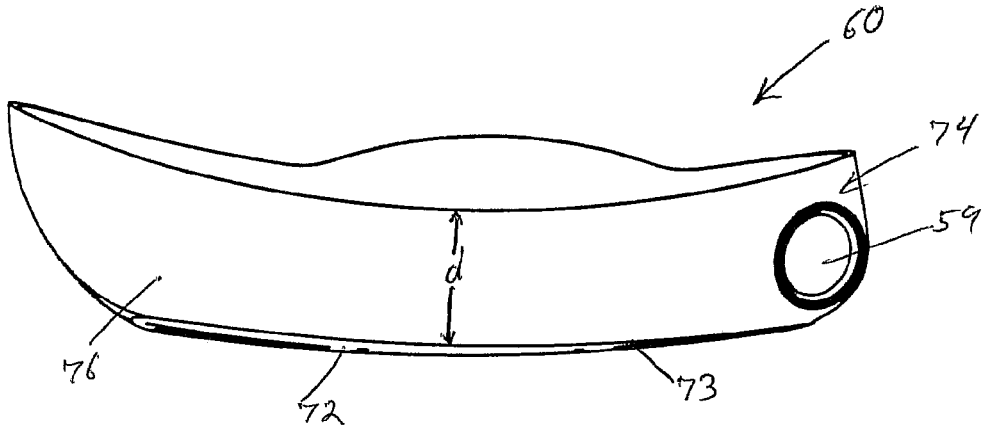
FIG. 22 is an isolated top plan view of the face component of FIG. 20.
Figure 23:
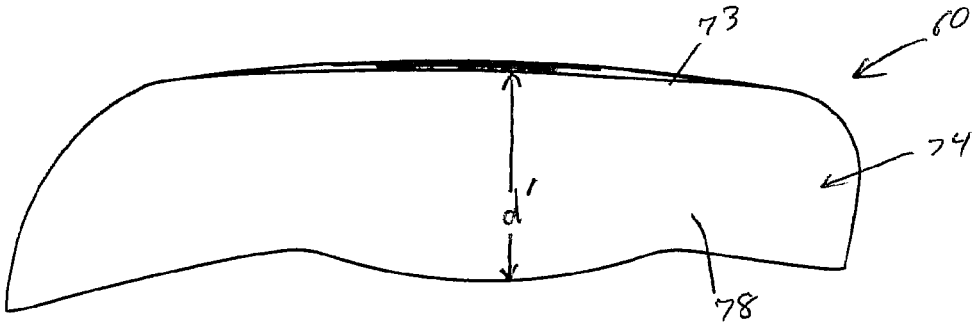
FIG. 23 is an isolated bottom plan view of the face component of FIG. 20.

FIGS. 18–19 illustrate the upper section 200 of the aft-body 61. The upper section 200 preferably comprises the crown portion 62 and an upper section of the ribbon 90. The crown portion 62 of the aft-body 61 is generally convex toward the sole 64, and engages the ribbon section 90 of sole portion 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The crown portion 62 preferably has a variable thickness, with central regions 230 and 232 (FIG. 14) having a greater thickness than peripheral regions of the crown. The variable thickness of the crown portion 62 improves its durability. The undercut portion 62*a* has a similar thickness to the crown portion 62. The interior surface of the upper section 200 has a plurality of interior projections 179 the engage the first ledge 250 of the lower section 202. The upper section 200 has a ledge 254 that engages the second ledge 252 of the lower section 202. As explained above, the upper section 200 and the lower section 202 are joined together preferably through use of an adhesive. An aft-body gap 205 is preferably created upon joining of the upper section 200 and the lower section 202. The crown undercut portion 62*a* has a plurality of undercut projections 177 extending upward from an exterior surface, and a plurality of gap projections 175 extending outward from the edge 190 of the crown portion 62. The plurality of gap projections 175 maintain the annular gap 170 between the crown portion 62 and the return portion 74.

FIGS. 25 and 26 illustrate the hollow interior 46 of the club head 42. The hosel 54 is disposed within the hollow interior 46, and is located as a part of the face component 60. The hosel 54 may be composed of a similar material to the face component 60, and is preferably secured to the face component 60 through welding or the like. The hosel 54 may also be integrally formed with the face component 60. Additionally, the hosel 54 may be composed of a non-similar material that is lightweight and secured using bonding or other mechanical securing techniques. A hollow interior of the hosel 54 is defined by a hosel wall 120 that forms a tapering tube from the aperture 59 to the sole portion 64. The shaft 48 is disposed within a hosel insert 121 that is disposed within the hosel 54. Such a hosel insert 121 and hosel 54 are described in U.S. Pat. No. 6,352,482, entitled Golf Club With Hosel Liner, which pertinent parts are hereby incorporated by reference. Further, the hosel 54 is preferably located rearward from the striking plate portion 72 in order to allow for compliance of the striking plate portion 72 during impact with a golf ball. In one embodiment, the hosel 54 is disposed 0.125 inch rearward from the striking plate portion 72.

Figure 32:
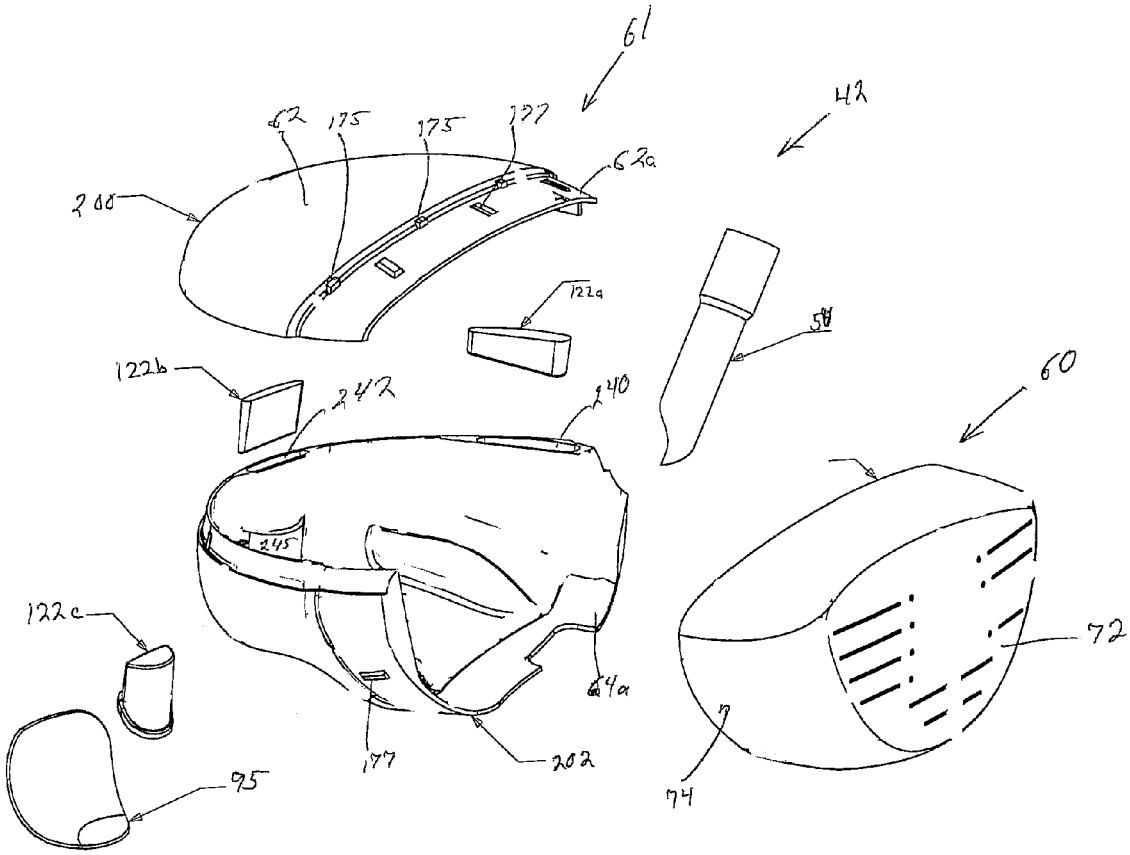
FIG. 32 is an exploded view of a golf club head.

As shown in FIG. 32, weighting members 122*a*, 122*b* and 122*c* are preferably disposed within the heel weight cavity 240, the rear weight cavity 242 and the aft weight cavity 244, respectively. In a preferred embodiment, all of the weighting members 122*a*, 122*b* and 122*c* are utilized in order to increase the moment of inertia and control the center of gravity of the golf club head 42. However, those skilled in the pertinent art will recognize that none or only one or two of the weighting members 122*a*, 122*b* and 122*c*, and also additional weighting members, may be placed in locations of the club head 42 in order to influence the center of gravity, moment of inertia, or other inherent properties of the golf club head 42. A preferred use of weighting members to influence the center of gravity of the a golf club head is disclosed in co-pending U.S. patent application Ser. No. 10/249,510, filed on Apr. 15, 2003, for a Golf Club Head With Customizable Center Of Gravity, and assigned to Callaway Golf Company, which is hereby incorporated by reference in its entirety.

In a preferred embodiment, the weighting members 122*a*, 122*b* and 122*c* are bonded within the heel weight cavity 240, the rear weight cavity 242 and the aft-weight cavity 244, respectively. Individually, each of the weighting members 122*a*, 122*b* and 122*c* has a mass ranging from 1 grams to 20 grams, preferably from 2 grams to 15 grams. Each of the weighting members 122*a*, 122*b* and 122*c* has a density ranging from 5 grams per cubic centimeters to 20 grams per cubic centimeters, more preferably from 7 grams per cubic centimeters to 12 grams per cubic centimeters, and most preferably 8.0 grams per cubic centimeters.

Figure 29:
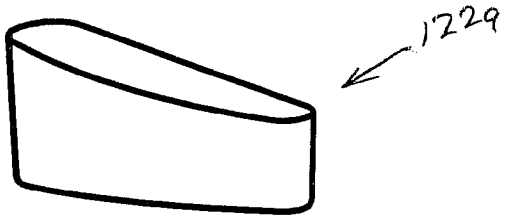
FIG. 29 is an isolated view of a heel weight component of a golf club head.
Figure 30:
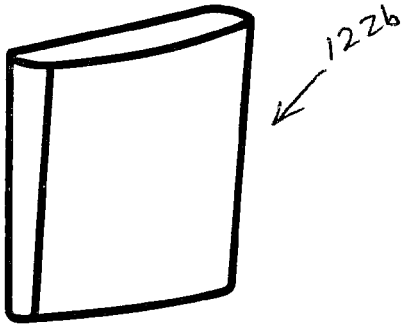
FIG. 30 is an isolated view of a rear weight component of a golf club head.
Figure 31:
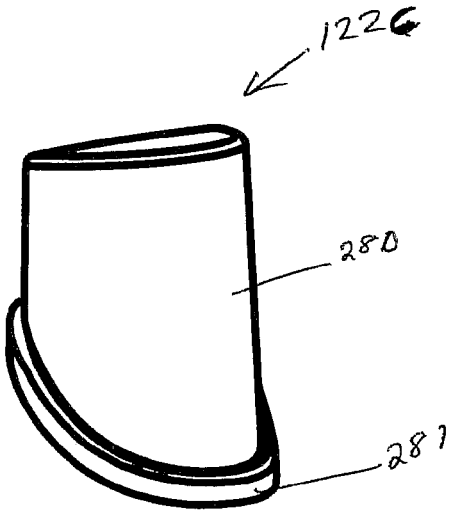
FIG. 31 is an isolated view of an aft weight component of a golf club head.

As shown in FIGS. 29–31, each of the weighting members 122*a*, 122*b* and 122*c* is sized to fit within an appropriate cavity. The aft weight member 122*c* has a body 280 and a flange 281. Each of the weighting members 122*a*, 122*b* and 122*c* is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weighting members 122*a*, 122*b* and 122*c* is an injection molded thermoplastic polyurethane integrated with tungsten to have a density of 8.0 grams per cubic centimeters. In a preferred embodiment, each of the weighting members 122*a*, 122*b* and 122*c* is composed of from 50 to 95 volume percent polyurethane and from 50 to 5 volume percent tungsten. Also, in a preferred embodiment, each of the weighting members 122*a*, 122*b* and 122*c* is composed of from 10 to 25 weight percent polyurethane and from 90 to 75 weight percent tungsten. Those skilled in the pertinent art will recognize that other high density materials may be utilized as an optional weighting member without departing from the scope and spirit of the present invention. Alternatively, the ribbon section 90 may have a thickened region to provide mass for the aft-body 61.

As mentioned earlier, the aft weight cavity 244 is accessible from the exterior of the golf club head 42, even after the face component 60 and the aft-body 61 have been assembled. The aft weight cavity 244 allows for proper swing weighting of the golf club head 42. Once the appropriate aft weight member 122 has been inserted into the aft weight cavity 244, the aft weight cavity 244 is covered by a skid plate 95. The skid plate 95 is preferably made of steel, but may also be made of any other durable metallic or non-metallic material.

Figure 13:
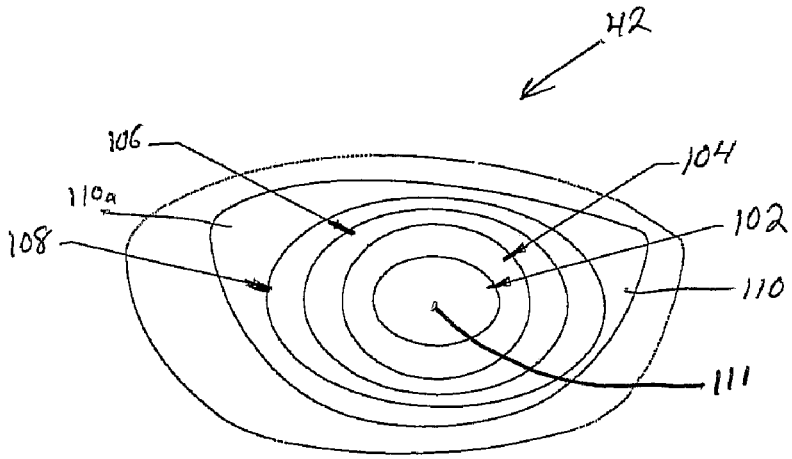
FIG. 13 is a front view of a golf club head illustrating regions of thickness.

FIG. 13 illustrates a preferred embodiment of the face component 60 of the golf club head 42. FIG. 13 illustrates the variation in the thickness of the striking plate portion 72, which preferably ranges from 0.010 inch to 0.250 inch. The striking plate portion 72 is preferably partitioned into elliptical regions 102, 104, 106 and 108, each having a different thickness. In a preferred embodiment in which the face component 60 is composed of a titanium or titanium alloy material, a central elliptical region 102 preferably has the greatest thickness that ranges from 0.090 inch to 0.130 inch, preferably from 0.110 inch to 0.125 inch, and is most preferably 0.120 inch. The central elliptical region 102 preferably has a uniform thickness. A first concentric region 104 preferably has the next greatest thickness that ranges from 0.085 inch to 0.115 inch, preferably from 0.095 inch to 0.111 inch. The first concentric region 104 preferably has a thickness that transitions in thickness from the central elliptical region 102 to the second concentric region 106. The second concentric region 106 preferably has the next greatest thickness, which ranges from 0.080 inch to 0.100 inch, preferably from 0.085 inch to 0.097 inch. The second concentric region 106 preferably has a thickness that transitions from the first concentric region 104 to the third concentric region 108. The third concentric region 108 preferably has the next greatest thickness, which ranges from 0.075 inch to 0.090 inch, preferably from 0.080 inch to 0.087 inch. The third concentric region 108 preferably has a thickness than transitions from the second concentric region 106 to a periphery region 110. The periphery region 110 preferably has a thickness that ranges from 0.055 inch to 0.085 inch, and is most preferably 0.072 inch. The variation in the thickness of the striking plate portion 72 allows for the greatest thickness to be localized in the center 111 of the striking plate portion 72 thereby maintaining the flexibility of the striking plate portion 72 which corresponds to less energy loss to a golf ball and a greater coefficient of restitution without reducing the durability of the striking plate portion 72.

Figure 24:
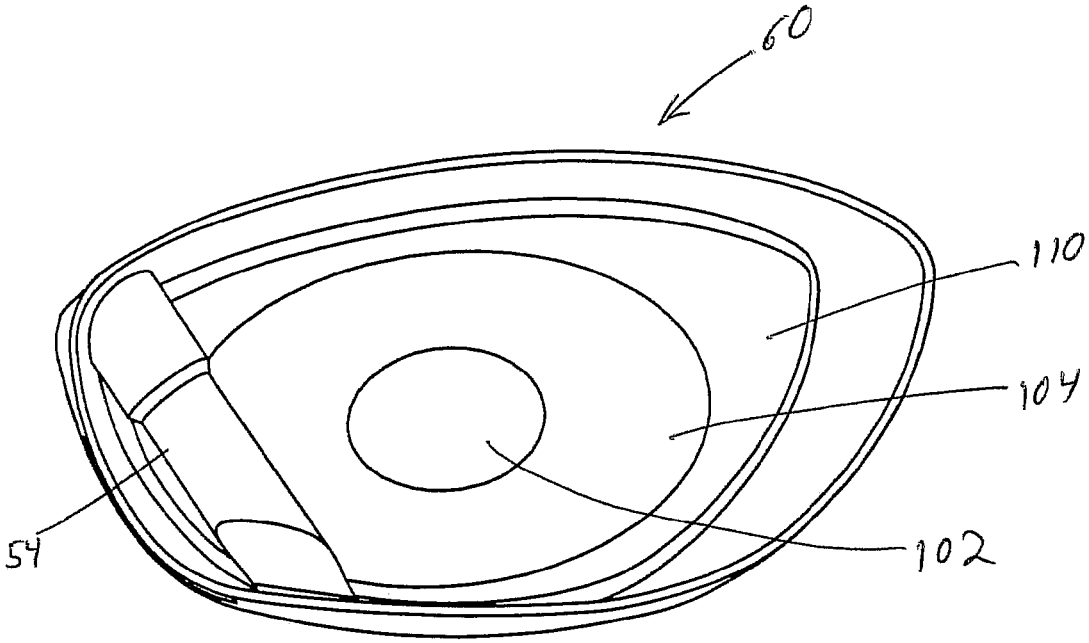
FIG. 24 is an isolated interior view of a face component of a golf club head.

FIG. 24 illustrates an alternative embodiment of the thickness of the striking plate portion 72, which has only three regions of thickness, 102, 104 and 110. Other alternative embodiments of the thickness of the striking plate portion 72 are disclosed in U.S. Pat. No. 6,471,603, for a Contoured Golf Club Face and U.S. Pat. No. 6,398,666 for a Golf Club Striking Plate With Variable Thickness, both of which are owned by Callaway Golf Company and which pertinent parts are hereby incorporated by reference.

As mentioned previously, the face component 60 is preferably forged from a rod of metal material. One preferred forging process for manufacturing the face component is set forth in U.S. Pat. No. 6,440,011, entitled Method For Processing A Striking Plate For A Golf Club Head, owned by Callaway Golf Company, and hereby incorporated by reference in its entirety. Alternatively, the face component 60 is cast from molten metal in a method such as the well-known lost-wax casting method. Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged preform, and like manufacturing methods. Yet further methods include diffusion bonding titanium sheets to yield a variable face thickness face and then superplastic forming.

Alternatively, the face component 60 is composed of an amorphous metal material such as disclosed in U.S. Pat. No. 6,471,604, owned by Callaway Golf Company, and which pertinent parts are hereby incorporated by reference in its entirety.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 of the present invention under standard USGA test conditions with a given ball ranges from approximately 0.81 to 0.94, preferably ranges from 0.83 to 0.883 and is most preferably 0.87.

Figure 1A:
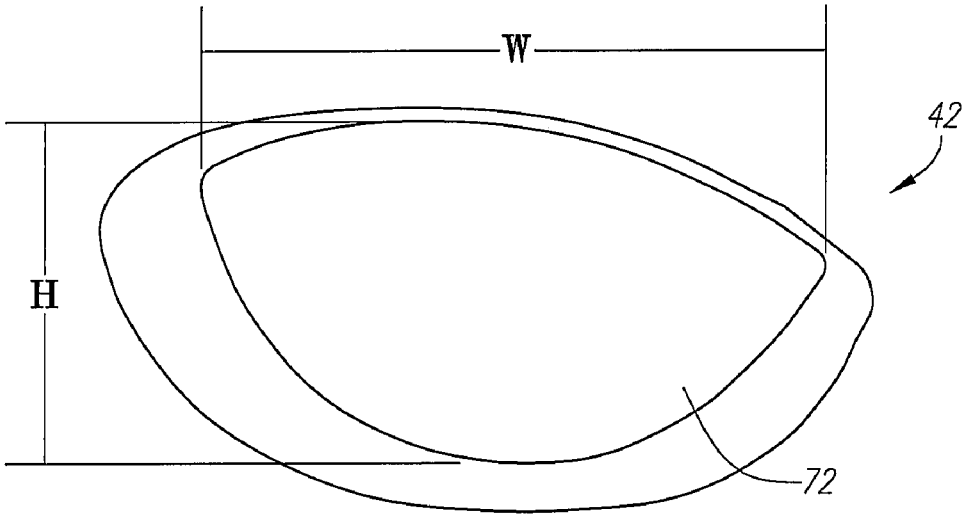
FIG. 1A is a front view of a golf club illustrating the measurement for the aspect ratio of the face.
Figure 2:
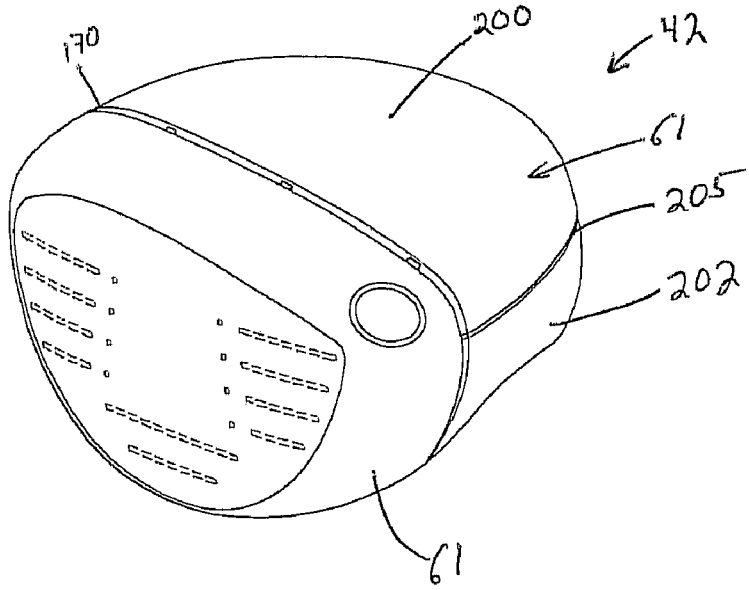
FIG. 2 is a top perspective view of a golf club head.
Figure 3:
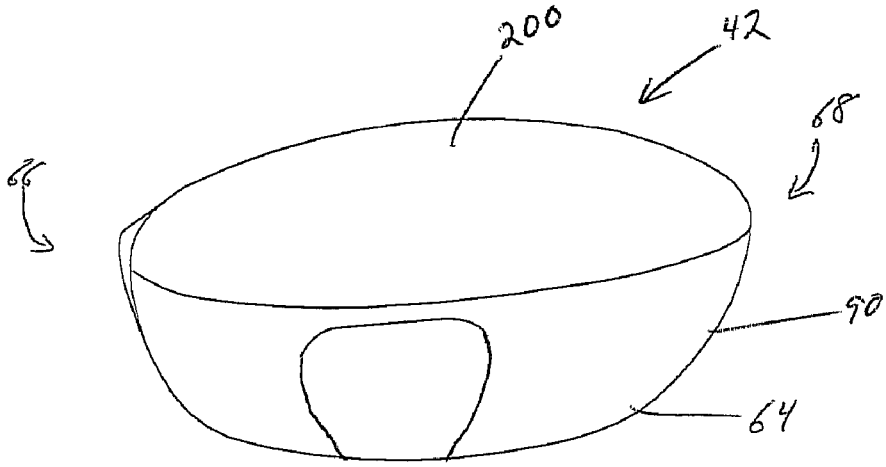
FIG. 3 is rear view of the golf club head of FIG. 2.
Figure 4:
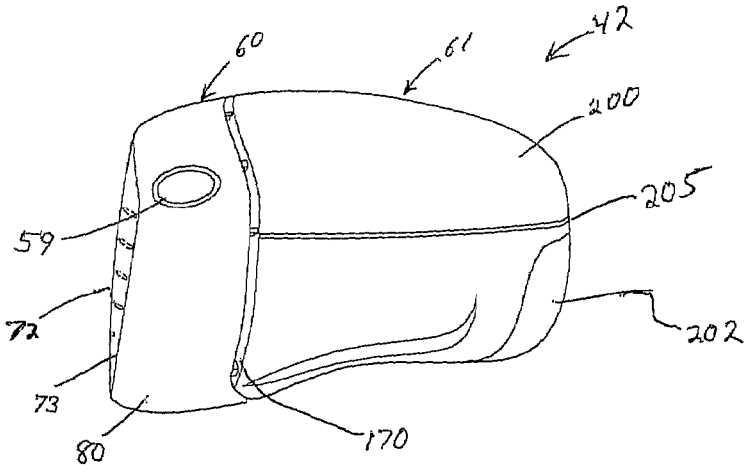
FIG. 4 is a heel side plan view of the golf club head of FIG. 2.

Additionally, the striking plate portion 72 of the face component 60 has a smaller aspect ratio than face plates of the prior art. The aspect ratio as used herein is defined as the width, "$W_f$" of the face divided by the height, "$H_f$", of the face, as shown in FIG. 1A. In one preferred embodiment, the width $W_f$ is 78 millimeters and the height $H_f$ is 48 millimeters giving an aspect ratio of 1.625. In conventional golf club heads, the aspect ratio is usually much greater than 1. For example, the original GREAT BIG BERTHA® driver had an aspect ratio of 1.9. The striking plate portion 72 of the present invention has an aspect ratio that is no greater than 1.7. The aspect ratio of the present invention preferably ranges from 1.0 to 1.7. One embodiment has an aspect ratio of 1.3. The striking plate portion 72 of the present invention is more circular than faces of the prior art. The face area of the striking plate portion 72 of the present invention ranges from 4.00 square inches to 7.50 square inches, more preferably from 5.00 square inches to 6.5 square inches, and most preferably from 5.8 square inches to 6.0 square inches.

The club head 42 of the present invention also has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 330 cubic centimeters to 510 cubic centimeters, even preferably 350 cubic centimeters to 465 cubic centimeters, and most preferably 385 cubic centimeters or 415 cubic centimeters.

The club head 42 of the present invention has a two-point keel, which affects the loft angle and face angles of the club head 42 relative to the lie angle.

The mass of the club head 42 of the present invention ranges from 165 grams to 225 grams, preferably ranges from 175 grams to 205 grams, and most preferably from 190 grams to 200 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting members 122*a*, 122*b* and 122*c* have a combined mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. Additionally, epoxy, or other like flowable materials, in an amount ranging from 0.5 grams to 5 grams, may be injected into the hollow interior 46 of the golf club head 42 for selective weighting thereof.

Figure 5:
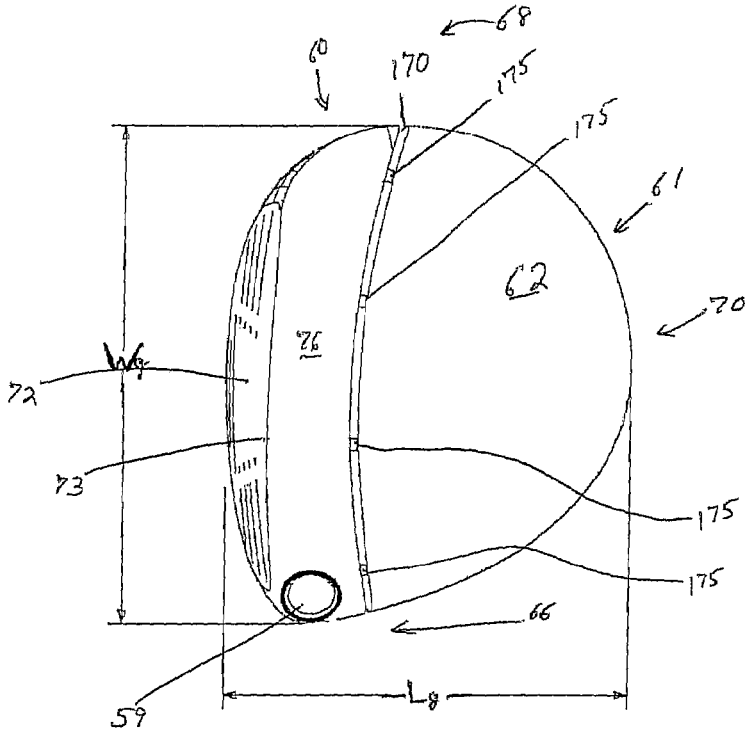
FIG. 5 is a top plan view of the golf club head of FIG. 2.
Figure 6:
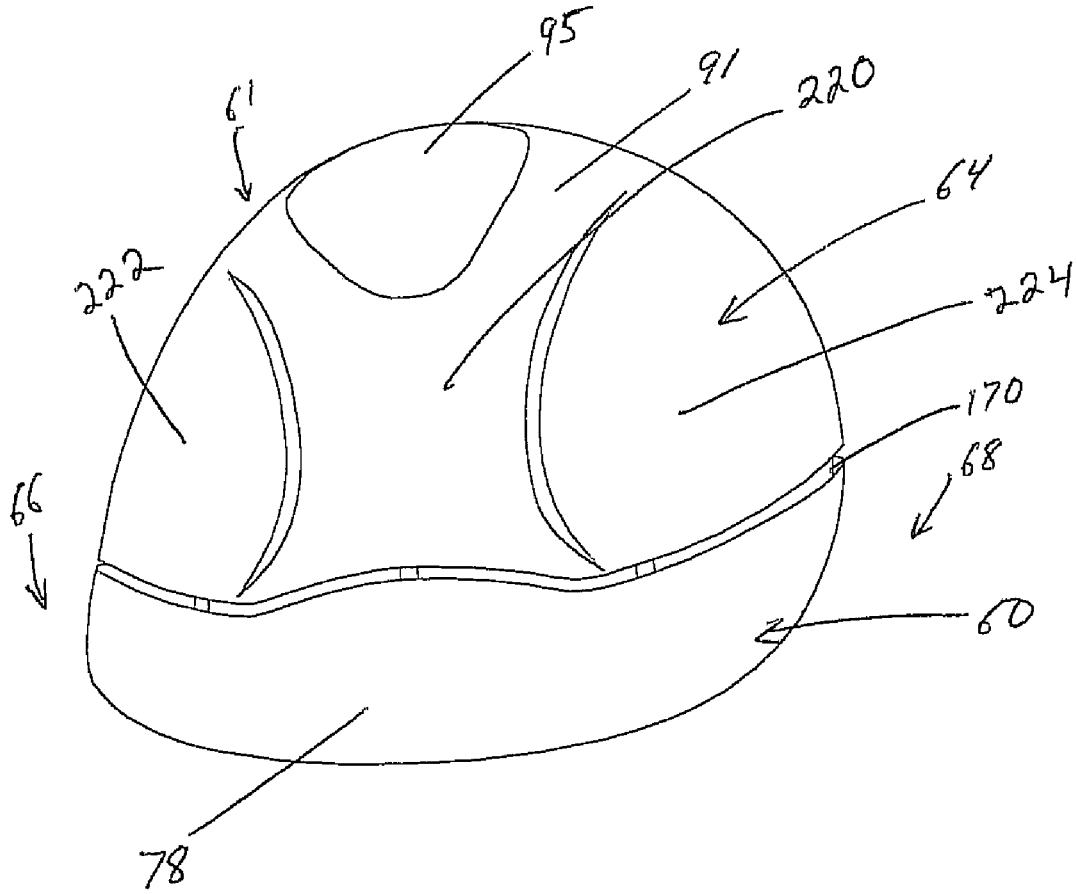
FIG. 6 is a bottom view of the golf club head of FIG. 2.
Figure 7:
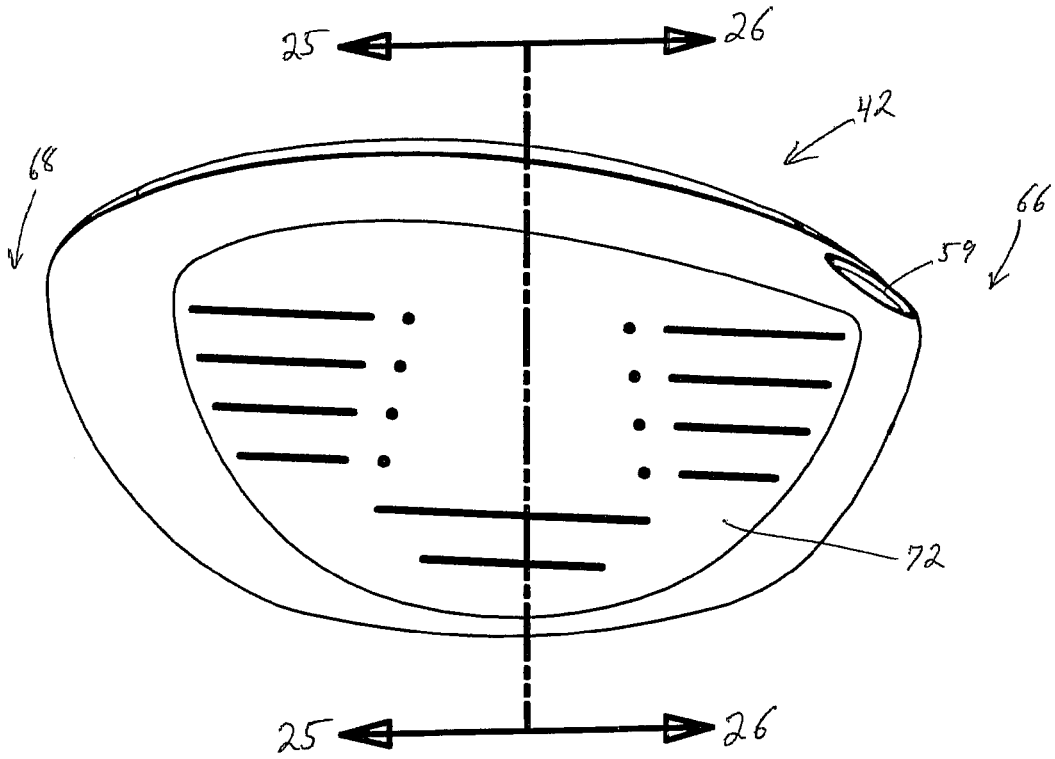
FIG. 7 is a front view of the golf club head.
Figure 8:
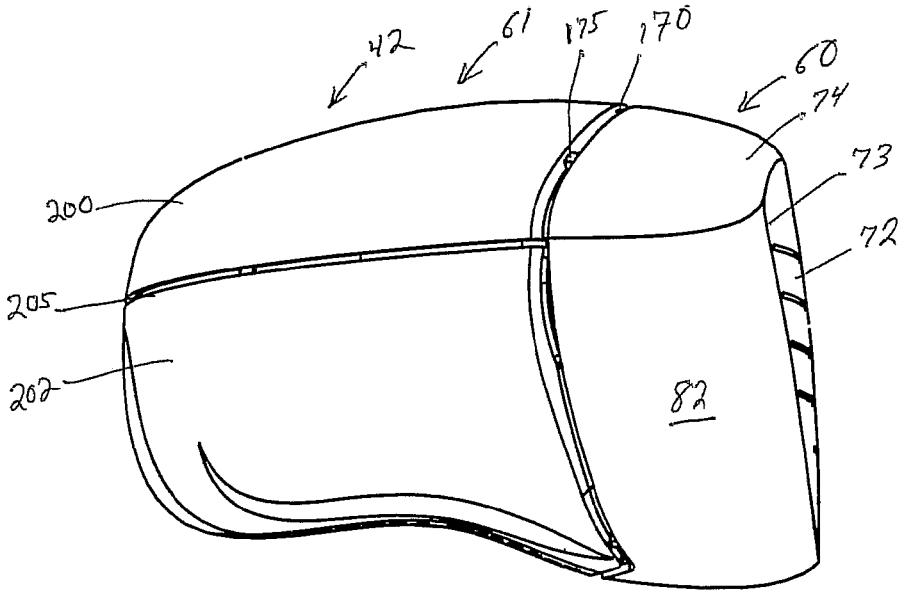
FIG. 8 is a toe side view of the golf club head of FIG. 2.
Figure 12:
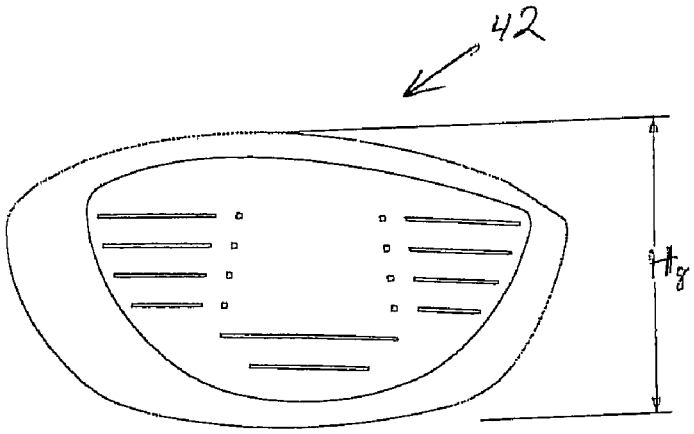
FIG. 12 is a front view of a golf club head.

As shown in FIG. 5, the length, "$L_g$", of the club head 42 from the striking plate portion 72 to the rear section of the crown portion 62 preferably ranges from 3.0 inches to 4.5 inches, and is most preferably 3.5 inches. As shown in FIG. 12, the height, "$H_g$", of the club head 42, as measured while in striking position, preferably ranges from 2.0 inches to 3.5 inches, and is most preferably 2.50 inches. As shown in FIG. 5, the width, "$W_g$" of the club head 42 from the toe section 68 to the heel section 66 preferably ranges from 4.0 inches to 5.0 inches, and more preferably 4.4 inches.

Figure 9:
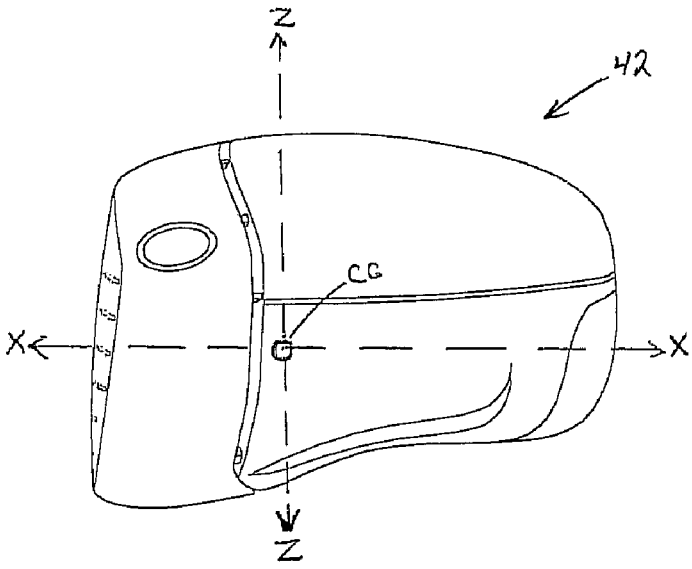
FIG. 9 is a heel side plan view of a golf club head illustrating the Z axis and X axis through the center of gravity.
Figure 10:
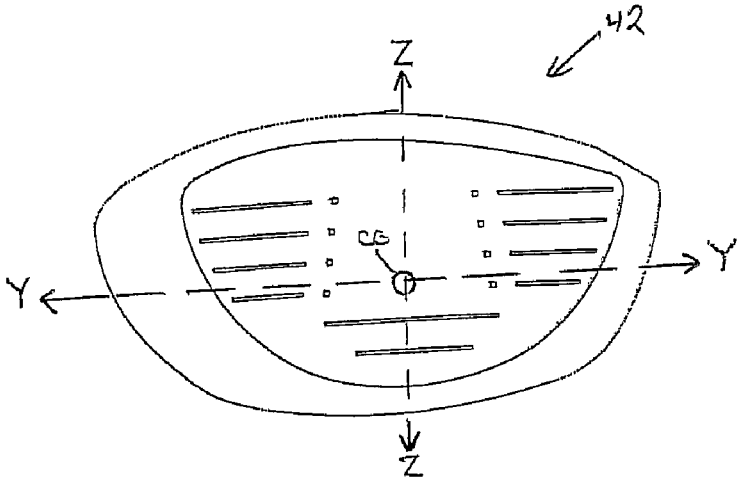
FIG. 10 is a front plan view of a golf club head illustrating the Z axis and Y axis through the center of gravity.

FIGS. 9 and 10 illustrate the axes of inertia through the center of gravity of the golf club head. The axes of inertia are designated X, Y and Z. The X axis extends from the striking plate portion 72 through the center of gravity, CG, and to the rear of the golf club head 42. The Y axis extends from the toe section 68 of the golf club head 42 through the center of gravity, CG, and to the heel section 66 of the golf club head 42. The Z axis extends from the crown portion 62 through the center of gravity, CG, and to the sole portion 64.

As defined in *Golf Club Design, Fitting, Alteration & Repair*, 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

Figure 11:
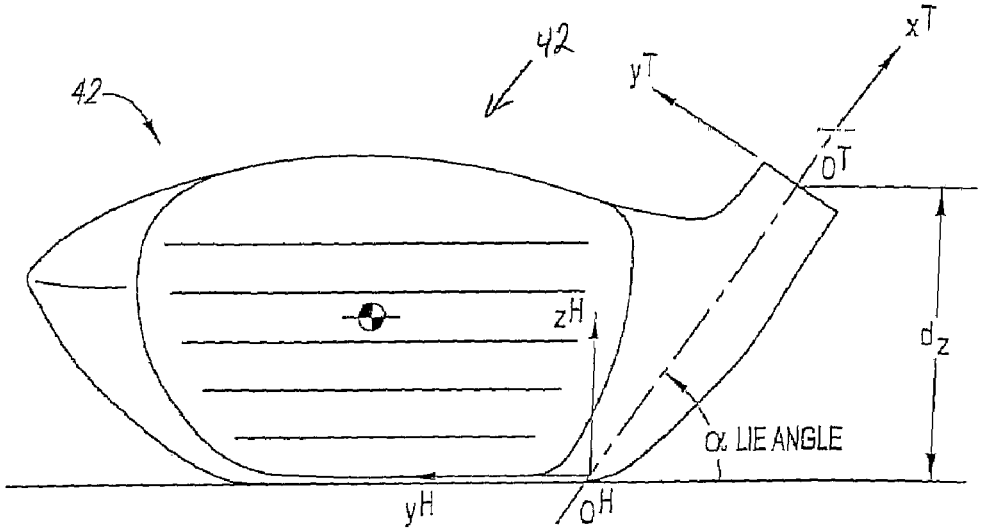
FIG. 11 is a front plan view of a golf club head illustrating the test frame coordinates $X^T$ and $Y^T$ and transformed head frame coordinates $Y^H$ and $Z^H$.
Figure 11A:
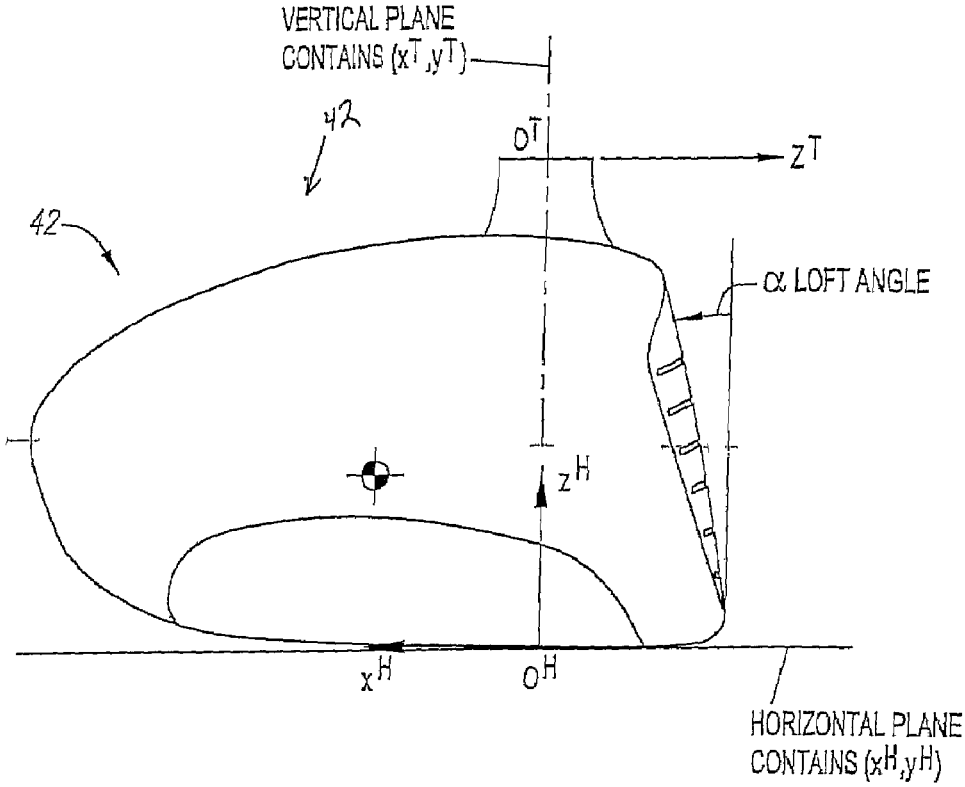
FIG. 11A is a toe end view of the golf club head illustrating the test frame coordinate $Z^T$ and transformed head frame coordinates $X^H$ and $Z^H$.

The center of gravity and the moment of inertia of a golf club head 42 are preferably measured using a test frame ($X^T$, $Y^T$, $Z^T$), and then transformed to a head frame ($X^H$, $Y^H$, $Z^H$), as shown in FIGS. 11 and 11A. The center of gravity of a golf club head may be obtained using a center of gravity table having two weight scales thereon, as disclosed in U.S. Pat. No. 6,607,452, entitled High Moment Of Inertia Composite Golf Club, owned by Callaway Golf Company, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 42 of the present invention will range from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 42 of the present invention will range from 1500 g-cm$^2$ to 2750 g-cm$^2$, preferably from 2000 g-cm$^2$ to 2400 g-cm$^2$, and most preferably from 2100 g-cm$^2$ to 2300 g-cm$^2$. The moment of inertia, Ixx, about the X axis for the golf club head 42 of the present invention will range from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

In general, the golf club head 42 has products of inertia such as disclosed in U.S. Pat. No. 6,425,832, and is hereby incorporated by reference in its entirety. Preferably, each of the products of inertia, Ixy, Ixz and Iyz, of the golf club head 42 have an absolute value less than 100 grams-centimeter squared. Alternatively, the golf club head 42 has a at least one or two products of inertia, Ixy, Ixz and Iyz, with an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face component composed of a metal material, the face component having a striking plate portion and a return portion, the striking plate portion having a thickness in the range of 0.010 inch to 0.250 inch and the return portion having a thickness ranging from 0.010 inch to 0.250 inch, the return portion extending a distance ranging 0.25 inch to 1.5 inches from a perimeter of the striking plate portion; and an aft-body composed of a metal material selected from the group consisting of magnesium alloys, aluminum alloys, magnesium and aluminum, the aft-body having a crown portion, a sole portion and a ribbon portion, the aft-body attached to the return portion of the face component, the aft-body having at least one weight cavity for mass placement;

wherein the golf club head has a coefficient of restitution of 0.80 to 0.94.

2. The golf club head according to claim 1 wherein the striking plate portion has a thickness in the range of 0.055 inch to 0.125 inch.

3. The golf club head according to claim 1 wherein the striking plate has a variable face thickness.

4. The golf club head according to claim 1 further comprising at least one weighting member disposed within the at least one weight cavity, the weighting member having a mass ranging from 2 grams to 20 grams.

5. The golf club head according to claim 1 further comprising a skid plate covering the at least one weight cavity.

6. The golf club head according to claim 1 wherein the aft-body is composed of a magnesium alloy.

7. The golf club head according to claim 1 wherein the striking plate portion has an aspect ratio no greater than 1.7.

8. The golf club head according to claim 1 wherein the aft-body is composed of an injection molded metal material.

9. The golf club head according to claim 1 wherein the golf club head has a volume ranging from 290 cubic centimeters to 600 cubic centimeters.

10. The golf club head according to claim 1 wherein the moment of inertia about the Izz axis of the golf club head is greater than 3000 grams-centimeter squared.

11. The golf club head according to claim 1 wherein the face component is composed of a metal material selected from the group consisting of titanium alloy, amorphous metal, stainless steel and maraging steel.

12. A golf club head comprising:

a face component composed of a metal material, the face component having a striking plate portion and a return portion, the striking plate portion having a thickness in the range of 0.010 inch to 0.250 inch and the return portion having a thickness ranging from 0.010 inch to 0.250 inch, the return portion extending a distance ranging 0.25 inch to 1.5 inches; and an aft-body comprising an upper section and a lower section, the upper section comprising a crown portion and an upper ribbon portion, the lower section comprising a sole portion and a lower ribbon portion, the aft-body composed of a metal material selected from the group consisting of magnesium alloys, aluminum alloys, magnesium and aluminum, the aft-body attached to the return portion of the face component, the aft-body having a thickness ranging train 0.0 15 inch to 0.100 inch;

wherein the moment of inertia about the Izz axis through the center of gravity is greater than 3000 grams-centimeter squared, and the moment of inertia about the Iyy axis though the center of gravity is greater than 1900 grams-centimeter squared.

13. The golf club head according to claim 12 wherein the face component is composed of a metal material selected from the group consisting of titanium alloy, amorphous metal, stainless steel and maraging steel.

14. A golf club head comprising:

a face component composed of a metal material, the face component having a striking plate portion and a return portion, the striking plate portion having a thickness in the range of 0.010 inch to 0.250 inch, the return portion extending a distance ranging 0.25 inch to 1.5 inches from a perimeter of the striking plate portion; and an aft-body comprising an upper section and a lower section, the upper section comprising a crown portion and an upper ribbon portion, the lower section comprising a sole portion and a lower ribbon portion, the aft-body composed of a metal material selected from the group consisting of magnesium alloys, aluminum alloys, magnesium and aluminum, the aft-body attached to the return portion of the face component, the aft-body having a thickness ranging from 0.015 inch to 0.100 inch;

wherein the golf club head has a volume ranging from 350 cubic centimeters to 525 cubic centimeters and a mass ranging from 175 grams to 225 grams.

15. The golf club bead according to claim 14 wherein the face component is composed of a metal material selected from the group consisting of titanium alloy, amorphous metal, stainless steel and maraging steel.

16. A golf club head comprising:

a face component composed of a titanium allay material and comprising a return portion and a striking plate portion, the striking plate portion having concentric regions of varying thickness with the thickest region about the center of the striking plate portion; and an aft-body comprising an upper section and a lower section, the upper section comprising a crown portion, an upper ribbon portion and an inward recessed section, the lower section comprising a sole portion, a lower ribbon portion and an inward recessed section, the aft-body composed of an injection molded magnesium alloy material, the aft-body having a thickness ranging from 0.010 inch to 0.100 inch, the return portion overlapping the inward recessed portion and attached to the inward recessed portion, the ribbon portion having a heel weighting cavity, a rear weighting cavity and a toe weighting cavity.

17. The golf club head according to claim 16 wherein the crown portion, the sole portion, the ribbon portion and the return portion define a gap, the gap also defined by an exterior surface of the inward recessed portion, the gap having a distance from an edge of the return portion to an exposed edge of the aft-body ranging from 0.02 inch to 0.09 inch.

18. The golf club head according to claim 16 wherein the rear weighting cavity is accessible from an exterior of the aft-body, and further comprising a skid plate covering the rear weighting cavity.

* * * * *